United States Patent [19]

Hinzmann

[11] 4,063,480

[45] Dec. 20, 1977

[54] APPARATUS FOR SEVERING ROD-SHAPED SMOKERS' PRODUCTS

[75] Inventor: Alfred Hinzmann, Richmond, Va.

[73] Assignee: Hauni-Werke Korber & Co., KG, Hamburg, Germany

[21] Appl. No.: 681,909

[22] Filed: Apr. 30, 1976

[51] Int. Cl.[2] ..... B26D 7/14; B26D 7/06; A24C 5/50

[52] U.S. Cl. ..... 83/176; 83/17; 83/411 R

[58] Field of Search ..... 83/17, 18, 19, 175, 83/176, 411 R, 409, 410

[56] References Cited

U.S. PATENT DOCUMENTS

| | | | |
|---|---|---|---|
| 3,212,185 | 10/1965 | Keiter | 83/176 |
| 3,253,491 | 5/1966 | Rakowicz | 83/411 R |
| 3,382,874 | 5/1968 | Pinkham | 83/411 R |
| 3,712,162 | 1/1973 | Giatti | 83/411 R |

*Primary Examiner*—Donald R. Schran
*Attorney, Agent, or Firm*—Peter K. Kontler

[57] ABSTRACT

Filter rod portions in the flutes of a rotating drum are severed by a rotary disk-shaped knife to yield shorter sections which are used for the making of filter cigarettes. During severing, the filter rod portions are flexed by stationary components to produce tensional stresses in those parts of filter rod portions which move into the range of the knife. This enables the knife to make a clean cut and to become immediately separated from the shorter sections. The stationary components may include annular members which urge the outer parts of successive filter rod portions against sloping portions of bottom surfaces of the respective flutes. If the depth of the flutes is constant, the components further include stationary cams which extend into circumferential grooves of the drum and lift the central parts of successive filter rod portions out of the adjacent portions of the flutes during travel past the knife.

15 Claims, 7 Drawing Figures

APPARATUS FOR SEVERING ROD-SHAPED SMOKERS' PRODUCTS

BACKGROUND OF THE INVENTION

The present invention relates to apparatus for severing or subdividing rod-shaped articles, particularly portions of filter rods or analogous articles which constitute or form part of smokers' products. Still more particularly, the invention relates to apparatus of the type wherein the articles to be severed are moved sideways past one or more rotating or orbiting knives which are located in planes extending at right angles to the axes of the articles.

It is known to sever portions of filter rods, e.g., filter rod portions of four times unit length, during transport form a magazine toward the assembly conveyor of a machine for the making of filter cigarettes, cigarillos or cigars. The filter rod portions are severed by a rotary disk-shaped knife so that each thereof yields two coaxial filter rod sections of two times unit length each of which is suited for assembly with two plain cigarettes of unit length of form therewith a filter cigarette of double unit length. The severing operation is rather simple if the filter rod portions consist of acetate filters surrounded by a wrapper made of cigarette paper, imitation cork or the like. Such filter rod portions are sufficiently soft to be severed by a rotary knife which can stand long periods of use and can form clean cuts across the wrappers as well as across the rod-like filter consisting of fibrous filter material. Problems arise when the filter rod portions consist of extruded profiled synthetic plastic material which exhibits little elasticity. Such material is rather hard and offers considerable resistance to severing so that the knife or knives must be driven by powerful prime movers and their cutting edges become dull after short periods of use. Moreover, the knife or knives become overheated as a result of friction between the sides of their cutting edges and the material of the filter rod portions. In many instances, the friction is high enough to cause the knife or knives to jam with resulting lengthy interruptions of operation and substantial losses in output, especially if the severing apparatus is used in a high-speed machine which can turn out up to and in excess of 4,000 smokers' products per minute.

SUMMARY OF THE INVENTION

An object of the invention is to provide an apparatus which can be used with advantage for severing of relatively soft and highly elastic as well as of relatively hard, tough and rather rigid rod-shaped articles, especially portions of filter rods or analogous rod-shaped articles which constitute or form part of smokers' products.

Another object of the invention is to provide a severing apparatus whose knife or knives can cut across rod-shaped articles with a minimum of friction and whose knife or knives are unlikely to jam during severing of articles even if the knife or knives receive motion from relatively small and economical prime movers.

A further object of the invention is to provide a novel and improved apparatus for severing portions of filter rods in machines for the production of filter-tipped smokers' products.

An additional object of the invention is to provide novel and improved means for holding, guiding and otherwise influencing rod-shaped articles during travel past one or more knives, especially disk-shaped rotary knives which serve to subdivide such articles into shorter rod-shaped sections.

The invention is embodied in severing apparatus for at least slightly flexible or bendable rod-shaped articles, particularly for portions of extruded filter rods or analogous articles which constitute to form part of smokers' products. The apparatus comprises a rotary drum shaped member or an analogous conveyor having flutes or other suitable article-receiving means arranged to accept (e.g., directly from a magazine) and to move sideways a succession of parallel rod-shaped articles in a predetermined direction toward, past and beyond a cutting or severing station, knife means (e.g., a rotary disk-shaped knife having a circumferentially complete cutting edge) provided at the cutting station and extending into a portion of the path of sidewise movement of successive rod-shaped articles in the receiving means to thus subdivide the articles into shorter rod-shaped sections (e.g., filter plugs of two times unit length) during movement of articles past the cutting station, and means for flexing or bending the articles in the receiving means, at least while the articles move past the severing station, to thus promote the severing action of the knife means by applying a tensional stress to those parts of successive articles which move along the aforementioned portion of the path of sidewise movement of the articles. The flexing means preferably comprises a plurality of stationary components which can perform the additional function of holding the articles and their sections against uncontrolled movement due to inertia, gravity and/or centrifugal force. Such components are adjacent to the path of movement of articles and sections in the receiving means of the conveyor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
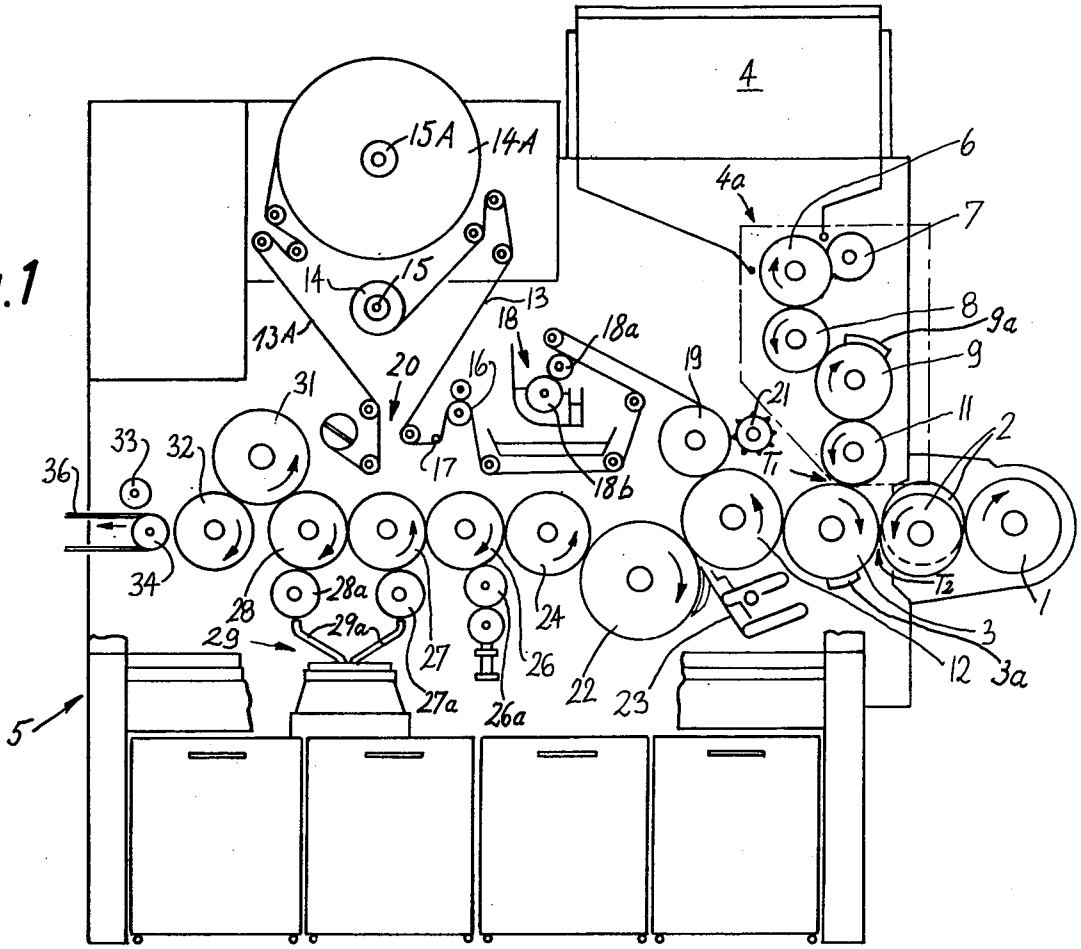
FIG. 1 is a schematic front elevational view of a filter cigarette making machine which embodies the improved apparatus.

FIG. 1 shows a filter cigarette making machine of the type known as MAX S produced by Hauni-Werke Korber & Co. KG, Hamburg, Federal Republic Germany. The filter cigarette making machine comprises a frame 5 and is directly coupled to a machine which produces plain cigarettes of unit length. Successive plain cigarettes are introduced into successive peripheral flutes of a rotary drum-shaped row forming conveyor 1 wherein the cigarettes form two rows. The cigarettes in the oddly numbered flutes form a first row which is nearer to one axial end, and the cigarettes in evenly numbered flutes form a second row which is nearer to the other axial end of the conveyor 1. The plain cigarettes of one row are transferred into successive flutes of one of two rotary drum-shaped aligning conveyors 2, and successive plain cigarettes of the other row are transferred into successive flutes of the other aligning conveyor 2. The conveyors 2 rotate at different speeds and/or transport the respective plain cigarettes through different distances prior to transfer of such cigarettes into successive flutes of a rotary drum-shaped assembly conveyor 3; such transfer takes place at a station T2. Each flute of the assembly conveyor 3 receives two coaxial plain cigarettes of unit length which are spaced apart by a distance least equal but preferably at least slightly exceeding the length of a filter rod section of two times unit length.

The frame 5 of the filter cigarette making machine further supports a magazine or hopper 4 for a supply of parallel filter rod portions of four times unit length. The outlet **4*a* of the magazine 4 receives a portion of a fluted rotary drum-shaped conveyor 6 forming part of a severing apparatus which is constructed and assembled in accordance with one embodiment of the invention. The flutes of the conveyor 6 receive discrete filter rod portions 38 (see FIG. 2) of four times unit length during travel past the outlet 4*a* and the flutes thereupon transport such filter rod portions past a rotary disk-shaped knife 7 which severs each filter rod portion midway between its ends so that each such portion yields two filter rod sections 44 (FIG. 3) of two times unit length. The plane of the disk-shaped knife 7 is normal to the axis of rotation of the conveyor 6**.

The thus obtained pairs of filter rod sections 44 of double unit length are transferred into the flutes of two rotary drum-shaped staggering conveyors 8 (only one shown in FIG. 1) which rotate at different speeds and/or transport the respective sections 44 through different distances in order to move the originally coaxial sections out of axial alignment with each other. The staggering conveyors 8 deliver filter rod sections 44 of two times unit length into successive flutes of a rotary drum-shaped shuffling conveyor 9 which cooperates with one or more stationary cams **9*a* to convert the sections 44 into a single row wherein each preceding section is in exact register with the next-following section. Successive sections 44 of the thus obtained row are transferred into successive flutes of a rotary drum-shaped accelerating conveyor 11 which inserts successive sections into successive flutes of the assembly conveyor 3. This takes place at a transfer station T1. Such flutes thereupon move past the station T2 to receive pairs of spaced-apart plain cigarettes of unit length so that each flute of the conveyor 3 which advances beyond the station T2 contains a group of three coaxial rod-shaped articles, namely, two plain cigarettes of unit length and a filter rod section 44 of two times unit length therebetween. The conveyor 3 transports such groups between two condensing cams 3*a* which cause the plain cigarettes of successive groups to move nearer to and into abutment with the respective ends of the associated filter rod section 44 of two times unit length. Such groups are transferred into successive flutes of a rotary drum-shaped transfer conveyor 12**.

The frame 5 further supports a spindle 15 for a roll 14 consisting of a convoluted web 13 made of cigarette paper, imitation cork or other suitable wrapping material. The web 13 is withdrawn from the roll 14 by two advancing rollers 16 and moves along a curling device 17 having a relatively sharp edge which extends transversely of the path for the web and eliminates or equalizes internal stresses in the web before the latter reaches the rotary applicator **18*a* of a paster 18. The applicator 18*a* receives a film of adhesive from a withdrawing roll 18*b* of the paster 18 and applies the adhesive film to the underside of the adjacent portion of the running web 13. The leader of the web 13 adheres to the foraminous peripheral surface of a rotary suction drum 19 which cooperates with a rotary knife 21 to subdivide the web 13 into a series of discrete adhesive-coated uniting bands. The uniting bands are attached to successive groups of rod-shaped articles in the flutes of the transfer conveyor 12 in such a way that each uniting band extends substantially tangentially of the respective group and adheres to the corresponding filter rod section 44** of two times unit length as well as to the inner end portions of the associated plain cigarettes of unit length.

The frame 5 further supports a second spindle 15A for a roll 14A of fresh web 13A which is automatically spliced to the running web 13 when the supply of web 13 (roll 14) is nearly exhausted. The splicing operation takes place at the station 20.

The conveyor 12 transfers successive groups of rod-shaped articles (each of which carries an adhesive-coated uniting band) onto a rotary drum-shaped wrapping conveyor 22 which cooperates with a stationary or mobile rolling device 23 to convolute the uniting bands around the respective filter rod sections 44 of two times unit length as well as around the inner end portions of the associated plain cigarettes of unit length and to thus complete the conversion of such groups into filter cigarettes of double unit length.

Successive filter cigarettes of double unit length are transferred into the flutes of a rotary drum-shaped drying conveyor 24 which causes the adhesive to set prior to transfer of successive cigarettes into the flutes of a rotary drum-shaped conveyor 26 which may but need not be similar to or identical with the aforementioned conveyor 6 for filter rod portions 38 of four times unit length. The conveyor 26 cooperates with a rotary disk-shaped knife **26*a* which severs each cigarette of double unit length midway between its ends (i.e., across the respective filter rod section 44 of two times unit length and across the convoluted uniting band) so that each such cigarette yields two filter cigarettes of unit length. The filter plugs of pairs of filter cigarettes of unit length in successive flutes of the conveyor 26 are adjacent to each other. The conveyor 26** may form part of a first testing device which examines the wrappers of successive filter cigarettes of double unit length and effects segregation of defective cigarettes, e.g., of cigarettes whose wrappers exhibit holes, frayed ends, open seams and/or other defects.

Pairs of coaxial filter cigarettes of unit length are thereupon transferred into successive flutes of a rotary drum-shaped conveyor 27 forming part of an inverting or tip turning device 29. The latter further comprises a second rotary drum-shaped conveyor 27*a* which receives one filter cigarette of each pair in the flutes of the conveyor 27 and delivers such cigarette to discrete arms 29*a* of an inverting unit serving to turn the cigarette through 180 degrees prior to introduction into a flute of a rotary drum-shaped conveyor 28*a*. The conveyor 28*a* delivers inverted filter cigarettes into alternate flutes of a conveyor 28 which also forms part of the tip turning device 29. The number of flutes on the conveyor 28 is twice the number of flutes on the conveyor 27; oddly numbered flutes of the conveyor 28 receive non-inverted filter cigarettes from the conveyor 27 and evenly numbered flutes of the conveyor 28 receive inverted filter cigarettes from the conveyor 28*a*. The thus formed single row of filter cigarettes of unit length (the filter tips of all such cigarettes face in the same direction) is transferred into the flutes of a further rotary drum-shaped conveyor 31 forming part of a second testing unit which monitors the tobacco-containing ends of the cigarettes and effects segregation of cigarettes having unsatisfactory tobacco-containing ends (too much tobacco or less than a satisfactory amount of tobacco). The ejection of defective filter cigarettes of unit length preferably takes place during movement in the flutes of a further rotary drum-shaped conveyor 32 which receives cigarettes from the conveyor 31 and delivers satisfactory cigarettes to the upper reach of a conveyor belt 36 trained over several pulleys 34 (one shown in FIG. 1). The illustrated pulley 34 cooperates with a braking roller 33. The filter cigarettes which reach the upper reach of the conveyor belt 36 are transported to storage, to a tray filling device, to a pneumatic sender which propels cigarettes into the magazine of a packing machine, or directly into the packing machine, not shown.

Figure 2:
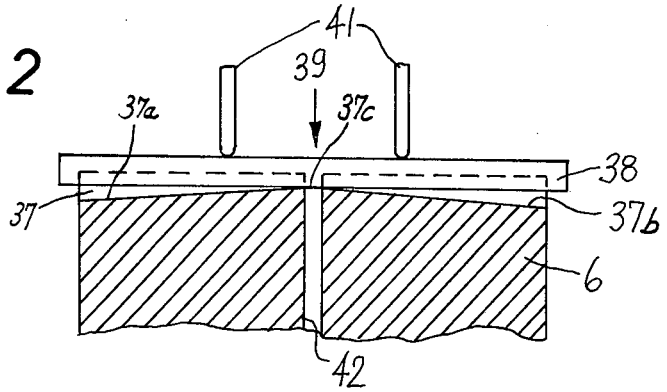
FIG. 2 is an enlarged fragmentary axial sectional view of a conveyor of the severing apparatus of FIG. 1, and further showing the means for flexing rod-shaped articles as well as a rod-shaped article prior to flexing.

Referring to FIG. 2, the conveyor 6 is a cylindrical drum having equally spaced peripheral article-receiving flutes 37 which extend in parallelism with its axis. The flute 37 which is shown in FIG. 2 is assumed to have been advanced beyond the outlet 4*a* of the magazine 4 and contains a filter rod portion 38 of four times unit length. The depth of the flute 37 increases in a direction from the center (at 39) toward both ends, i.e., toward the end faces of the conveyor 6, so that the bottom surface of the flute includes two mutually inclined portions 37*a*, 37*b* which make an angle greatly exceeding 90° but at least slightly less than 180°.

Successive flutes 37 which contain filter rod portions 38 travel along a flexing or bending device which includes two stationary components 41 extending in the direction of rotation of the conveyor 6 and having inwardly extending portions or cams 43 (FIGS. 3 and 4) whose distance from the periphery of the conveyor 6 is less than the distance between such periphery and the major portions of components 41. As a filter rod portion 38 approaches the cutting or severing station (shown in FIG. 3), it is held at three different points, namely, at the center by the apex 37*c* of the bottom surface of the respective flute 37 and at both sides of the center 39 by the inwardly extending portions 43 of the respective flexing components 41. The central portion of the conveyor 6 has a circumferential groove 42 successive increments of which receive a portion of the circumferentially complete cutting edge of the rapidly rotating knife 7 during travel past the severing station. The flexing or bending action of the components 41 may but need not be such that the end portions of a filter rod portion 38 which is about to be severed contact the outermost parts of the bottom surface portions 37*a*, 37*b*.

Figure 4:
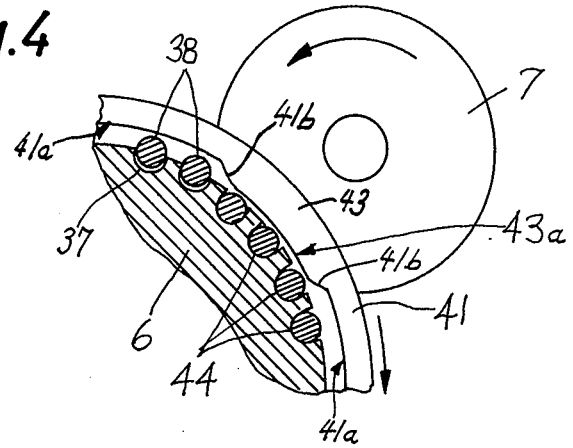
FIG. 4 is a sectional view as seen in the direction of arrows from the line IV-IV of FIG. 3.

The components 41 of the flexing device may be configurated in a manner as shown in FIG. 4, i.e., they may constitute portions of rings which are concentric with the conveyor 6 and comprise inwardly extending portions or cams 43 with gradual transition between the inner or end surfaces 41*a* of the major portions of components 41 into the inner or end surfaces 43*a* of the cams 43. The gradual transitions are shown at 41*b*. The extent to which the inner surfaces 43*a* are nearer to the axis of the conveyor 6 than the inner surfaces 41*a* is preferably proportional to the inclination of bottom surface portions 37*a*, 37*b* with respect to each other and to the axis of the conveyor 6. The components 41 are secured to the frame 5 of the filter cigarette making machine.

The severing operation is carried out as follows:

When an empty flute 37 travels below and along the outlet 4*a* of the magazine 4, it receives a discrete filter rod portion 38 in such a way that the center of the portion 38 rests on the apex 37*c* between the bottom surface portions 37*a*, 37*b*. Such flute then advances beyond the outlet 4*a* and moves along the inner surfaces 41*a* of the flexing components 41. Before a filled flute 37 enters the range of the knife 7, the respective filter rod portion 38 is engaged and flexed by the inwardly extending portions 43 so that it is tensioned in the region located radially outwardly of the apex 37*c*. As the cutting edge of the knife 7 severs that filter rod portion 38 which reaches the severing station, the slit which is formed by the cutting edge expands to form a wedge-like space between the thus obtained filter rod sections 44 (FIG. 3) of two times unit length. The flexing of successive portions 38 prior to and during severing exhibits several important advantages. Thus, the cut across each portion 38 is cleaner if the cutting edge of the knife 7 severs such portion in a region where the portion 38 is subjected to tensional stresses (as a result of flexing by 37*c* and 43, 43). Secondly, the inner end portions of freshly formed filter rod sections 44 move away from the respective sides of the cutting edge so that friction between the knife 7 and sections 44 is reduced to zero (or practically zero) as soon as the severing step is completed.

The manner in which the sections 44 are held in the respective flutes 37 during further transport toward the staggering conveyors 8 of FIG. 1 forms no part of the invention. This can be achieved by extending the components 41 of the flexing device all the way to the transfer station between the conveyors 6, 8 or by providing the conveyor 6 with suction ports (not shown) which communicate with the flutes 37 at both sides of the respective apices 37*c* and are connected to a suction generating sides as soon as the corresponding flute advances beyond the components 41.

Figure 3:
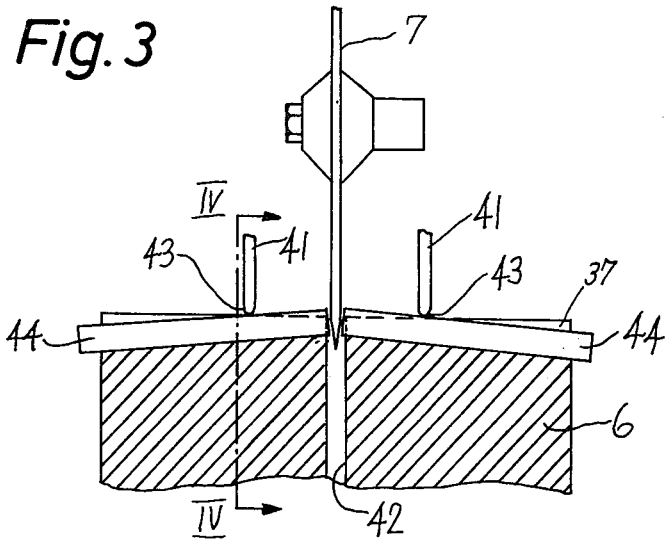
FIG. 3 shows the structure of FIG. 2 and the knife which severs the rod-shaped article while the latter is flexed in accordance with one embodiment of the invention.
Figure 5:
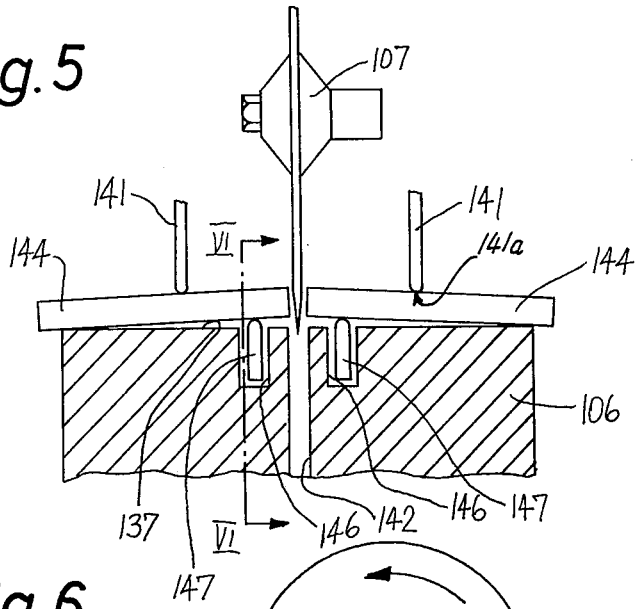
FIG. 5 is a sectional view similar to that of FIG. 3 but showing different flexing means.
Figure 6:
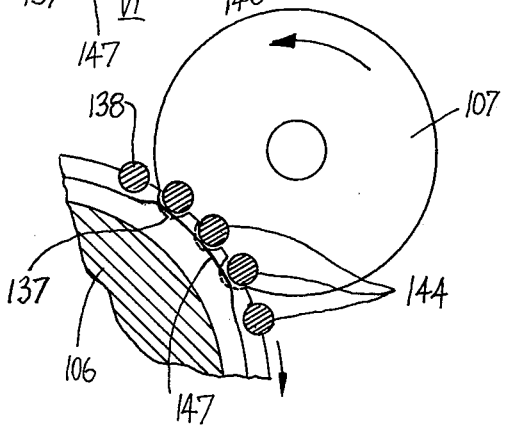
FIG. 6 is a sectional view as seen in the direction of arrows from the line VI-VI of FIG. 5.

FIGS. 5 and 6 show a modification of the severing apparatus of FIGS. 2 to 4. All such parts which are identical with or clearly analogous to those of the apparatus shown in FIGS. 2–4 are denoted by similar reference characters plus 100. The conveyor 106 has article-receiving flutes 137 of constant depth, i.e., the bottom surfaces of such flutes are parallel with the axis of the conveyor 106 all the way from the one to the other end. The components 141 of the flexing device do not have inwardly extending portions or cams corresponding to the portions 43 shown in FIGS. 3 and 4, i.e., their inner or end surfaces 141*a* are located at the same distance from the periphery of the conveyor 106 all the way from the one to the other end of each component 141, as considered in the circumferential direction of the conveyor 106.

At the severing or cutting station (where the cutting edge of the rotary disk-shaped knife 107 enters the circumferential groove 142 of the conveyor 106), the central parts of successive filter rod portions 138 of four times unit length are lifted away from the adjacent portions of the bottom surfaces of the respective flutes 137 by two stationary components or cams 147 which extend into circumferential grooves or recesses 146 of the conveyor 106. The grooves 146 flank the centrally located groove 142, and the latter is preferably located midway between the grooves 146.

When a filter rod portion 138 of four times unit length approaches the severing station, it is held by the inner or end surfaces 141*a* of the two outer flexing component 141 so that its outer ends contact the bottom surface of the respective flute 137. At the same time, the components or cams 147 lift the central part of such filter rod portion so that the filter rod portion 138 is flexed and tensioned in a region which is located radially outwardly of the groove 142. Such part of the filter rod portion 138 is severed by the circumferentially complete cutting edge of the knife 107 so that the filter rod portion yields two nearly coaxial filter rod sections 144 of two times unit lenth. The effect of flexing is the same as described in connection with FIGS. 2–4, i.e., the gap between the sections 144 assumes the shape of a wedge and the inner end faces of the sections 144 are out of frictional engagement with the cutting edge of the knife 107 as soon as the severing step is completed.

Figure 7:
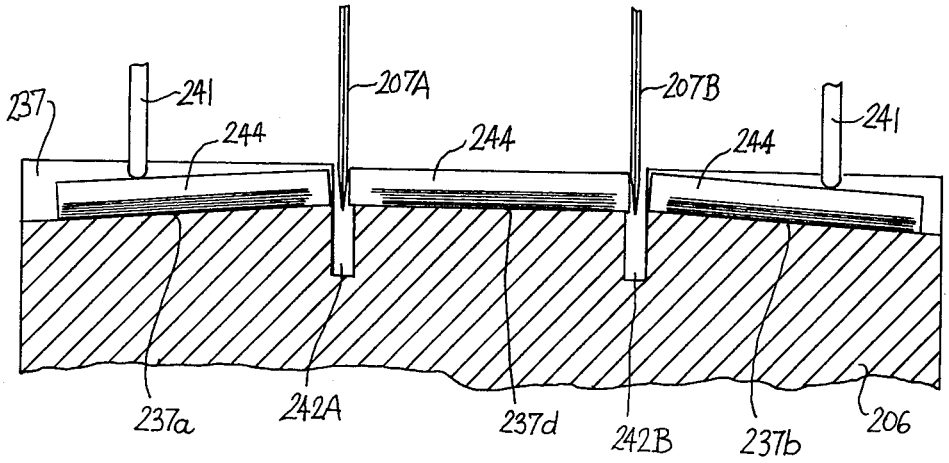
FIG. 7 is a sectional view similar to that of FIG. 3 or 5 but showing the subdivision of a rod-shaped article into three discrete sections.

FIG. 7 shows a portion of a third severing apparatus. This apparatus employs two preferably coaxial disk-shaped knives 207A, 207B which can subdivide rod-shaped articles (e.g., portions of extruded filter rods, each such portion being of six times unit length) into groups of three sections 244 of two times unit length. The conveyor 206 has grooves 242A, 242B for the respective knives 207A, 207B, axially parallel article-receiving flutes 237 each having a bottom surface consisting of two mutually inclined outer portions 237*a*, 237*b* and a centrally located portion or ledge 237*d* which is parallel to the axis of the conveyor 206 and hence normal to the planes of the two knives. The components 241 of the flexing or bending device engage those parts of the filter rod portion which are about to constitute the outer sections 244 and press such parts toward or against the bottom surface portions 237*a*, 237*b*. This results in generation of tensional stresses in those regions where the filter rod portion is about to be severed by the knives 207A, 207B. The apparatus of FIG. 7 reduces friction between the knives and the outer sections 244. The centrally located section 244 can be engaged by a customary shroud or attracted to the ledge 237*d* by suction.

The apparatus of FIG. 7 can be modified by mounting the knife 207A ahead of or behind the knife 207*b*, as considered in the direction of rotation of the conveyor 206. The flexing device then comprises three components 241 or three components 241 and one or two components corresponding to 147 in FIGS. 5–6, depending on the configuration of bottom surfaces of the flutes. The knife 207A or 207B subdivides each filter rod portion of six times unit length into a section 244 and a section of four times unit length, and the knife 207B and 207A thereupon subdivides each section of four times unit length into two sections 244. The just described apparatus constitutes a relatively simple modification of the structure shown in FIG. 7. Its advantage is that the cutting edges of the knives 207A, 207B are out of frictional engagement with the adjacent filter rod sections immediately upon completion of a cut.

The conveyor 26 of FIG. 1 may but need not be associated with a flexing device of the type shown in FIGS. 2–4 or 5–6 (or with analogous flexing means).

An important advantage of the flexing device is that the spreading movement of the inner end face of filter rod sections 44, 144 or 244 away from each other begins even before the severing step is completed, i.e., as soon as the cutting edge of the knife 7, 107, 107A or 107B begins to penetrate into the tensioned part of the wrapper of the respective filter rod portion of four or six times unit length. This insures that friction between the inner and faces of the shorter filter rod sections and the respective sides of the knife or knives is either zero or a minute fraction of friction in conventional severing apparatus wherein the filter rod portions lie flat against the bottom surfaces of the respective flutes during travel past the severing station. Reduction or elimination of friction results in the making of cleaner cuts. Moreover, such reduction or elimination of friction reduces the stresses upon the bearings for the knife or knives and upon the means for rotating the knife or knives at an elevated speed.

Without further analyses, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Severing apparatus for at least slightly flexible rod-shaped articles, particularly for portions of filter rods or analogous articles which constitute or form part of smokers' products, comprising a conveyor having article-receiving means arranged to accept and to move a succession of rod-shaped articles in a predetermined direction sideways toward, past and beyond a cutting station; knife means provided at said station and extending into a portion of the path of movement of successive articles in said receiving means to thus subdivide the articles into shorter rod-shaped sections during movement of articles past said station; and means for flexing the articles in said receiving means, at least while the articles move past said station, to thus promote the severing action of said knife means by applying a tensional stress to such parts of successive articles which move along said portion of said path.

2. Apparatus as defined in claim 1, wherein said flexing means comprises a plurality of stationary components adjacent to said path of sidewise movement of articles in said receiving means.

3. Apparatus as defined in claim 1, wherein said conveyor is a rotary member and said receiving means comprises flutes in the periphery of said member, said knife means including a rotary knife located in a plane which is normal to the axis of said member.

4. Apparatus as defined in claim 3, wherein said rotary member is a drum and said knife is a disk having a circumferentially complete cutting edge.

5. Apparatus as defined in claim 3, wherein each of said flutes has a bottom surface including first and second portions located at the opposite sides of said plane and sloping outwardly therefrom toward the axis of said rotary member, said flexing means including first and second components respectively adjacent to said first and second portions of the bottom surfaces of flutes moving toward and past said station and positioned to urge the adjacent portions of articles in such flutes toward the respective portions of the corresponding bottom surfaces.

6. Apparatus as defined in claim 5, wherein said components are stationary and comprise portions which engage and flex portions of articles in successive flutes moving past said station.

7. Apparatus as defined in claim 6, wherein each of said components has a first surface located at a first distance from said path and said portions of said components have article-engaging second surfaces located at a shorter second distance from said path.

8. Apparatus as defined in claim 7, wherein the difference between said distances is proportional to the mutual inclination of the first and second portions of each of said bottom surfaces.

9. Apparatus as defined in claim 5, wherein each of said bottom surfaces has an apex which is located in said plane.

10. Apparatus as defined in claim 9, wherein said first and second portions of each of said bottom surfaces make an obtuse angle of slightly less than 180 degrees.

11. Apparatus as defined in claim 3, wherein said flexing means comprises first and second components located at the opposite sides of said plane and positioned to maintain the neighboring portions of articles in the respective flutes during movement past said station, and at least one additional component extending into the flutes intermediate said first and second components and positioned to maintain the neighboring portions of articles out of contact with the bottom surfaces of the respective flutes during travel past said station so that the articles are flexed in said plane during severing by said knife.

12. Apparatus as defined in claim 11, wherein at least one of said components is stationary.

13. Apparatus as defined in claim 12, wherein said rotary member has two circumferential grooves flanking said plane and communicating with said flutes, said flexing means comprising two additional components each extending into a different one of said grooves and into those flutes which move past said station.

14. Apparatus as defined in claim 1, wherein said knife means has a cutting edge consisting of a material enabling said knife means to repeatedly sever articles which constitute portions of an extruded filter rod consisting at least in part of synthetic plastic material.

15. Apparatus as defined in claim 1, further comprising a magazine containing a supply of rod-shaped articles and arranged to feed such articles directly to said receiving means upstream of said cutting station, as considered in said direction, and additional conveyor means for accepting sections of severed articles from said receiving means downstream of said station.

* * * * *